US005099925A

United States Patent [19]

Glidden et al.

[11] Patent Number: 5,099,925

[45] Date of Patent: Mar. 31, 1992

[54] DRY SPRINKLER SYSTEM

[76] Inventors: Gary J. Glidden, c/o Glidden Technologies Ltd., Box 301, Newcastle, New Brunswick WLv 3M4, Canada; Alan G. W. Dry, c/o Ascolectric Limited, Box 160, Brantford, Ontario N3T 5M8, Canada

[21] Appl. No.: 214,810

[22] Filed: Jul. 5, 1988

Related U.S. Application Data

[63] Continuation of Ser. No. 884,161, Jul. 10, 1986, abandoned.

[30] Foreign Application Priority Data

Jul. 18, 1985 [CA] Canada ..... 487020

[51] Int. Cl.[5] ..... A62C 35/64; A62C 35/68

[52] U.S. Cl. ..... 169/17; 169/20

[58] Field of Search ..... 169/16, 17, 20, 22, 169/19, 23, 5

[56] References Cited

U.S. PATENT DOCUMENTS

| | | | |
|---|---|---|---|
| 260,192 | 6/1882 | Granger | 169/19 |
| 426,752 | 4/1890 | Clapp | 169/20 |
| 1,900,632 | 3/1933 | Boardman | 169/17 |
| 1,914,223 | 6/1933 | Tyden | 169/17 |
| 2,558,176 | 6/1951 | Gieseler | 169/19 |
| 2,706,006 | 4/1955 | Valente | 169/16 |
| 3,100,017 | 8/1963 | Johnson | 169/17 |
| 3,208,716 | 9/1965 | Rolfe . | |
| 3,883,314 | 6/1975 | Landsberg | 169/20 |
| 3,887,524 | 4/1975 | Glenn, Jr. | 169/17 |
| 3,913,884 | 10/1975 | Rolfe | 251/35 |
| 3,958,643 | 5/1976 | Landsberg | 169/20 X |
| 4,172,585 | 10/1979 | Rolfe | 251/357 |
| 4,286,668 | 9/1981 | McCormick | 169/22 |

FOREIGN PATENT DOCUMENTS

| | | | |
|---|---|---|---|
| 1105356 | 7/1981 | Canada . | |
| 209388 | 1/1987 | European Pat. Off. | 169/17 |
| 3627 | of 1894 | United Kingdom | 169/19 |
| 1077353 | 7/1967 | United Kingdom | 169/17 |

*Primary Examiner*—Margaret A. Focarino
*Assistant Examiner*—James M. Kannofsky
*Attorney, Agent, or Firm*—Pollock, Vande Sande & Priddy

[57] ABSTRACT

A dry sprinkler system includes a compressed gas pilot operated water valve between a water supply main and a dry sprinkler pipe, the valve being normally open and held closed upon activation of the pilot by water pressure.

2 Claims, 12 Drawing Sheets

SYSTEM WITH ON LINE MICRO-COMPRESSOR

SYSTEM WITH PRESSURE REGULATED RESERVOIR

DRY SPRINKLER SYSTEM

This application is a continuation of application Ser. No. 884,161, filed July 10, 1986, now abandoned.

BACKGROUND OF THE PRESENT INVENTION

This invention relates to a dry sprinkler system which is of such a size that it is suitable for domestic or small commercial applications.

Systems are presently known which are based upon utilizing dry piping up to the sprinkler head which is filled with water only when required to douse a fire. This type of dry system is used where the system is exposed to temperatures which are liable to drop below freezing which would normally freeze a wet sprinkler system.

The known dry sprinkler systems are, however, built around piping having a minimum diameter of around 2½ inches, and 2½ inch clapper valves are used. These clapper valves are held closed by the pressure of air or gas in the dry sprinkler pipes, the air being on one side of a clapper valve and water under pressure being on the other side of the clapper valve. This type of dry system has been in use for about 100 years and the clapper valve has been made of cast iron and although it has been possible to "down size" it to handle a 2½ inch supply pipe, it cannot be "down sized" any further in its present form and still function satisfactorily. Its high cost also limits its wider application for the protection of the public.

Clapper valves are also affected by water hammer such that if water hammer occurs in the piping system to which the clapper valve and sprinkler system are coupled, the clapper valve will often be jolted open and flood the supply pipes to the sprinklers which will not normally be noticed in operation so that if freezing temperatures occur when the supply pipes are full of water, freezing of the water will cause the sprinkler heads to open or the supply pipes to burst or both.

There has long been a requirement for a satisfactory sprinkler system for use in residential and small commercial units, however wet systems will not be suitable as, for instance, they cannot be used where the piping is in an attic which is outside the insulation of the living areas of the house or when the system serves an unheated area. A wet system is therefore not useable in a bungalow or in the top floor of a house where insulation is laid between and over joists in the standard manner. A dry sprinkler system would appear to be ideal for use in a residential or commerical building where the piping will pass through unheated areas, however it has only been used in commercial installations with piping no smaller than 2½ inches in diameter. As indicated above, the valves operating this system cannot be "down sized" below 2½ inches and function effectively.

SUMMARY OF THE PRESENT INVENTION

The present invention therefore has as its main object to provide a dry sprinkler system which is useable with pipe sizes ranging roughly from ¾ inch diameter up to 3 inches diameter and achieves this object by using a water valve which is operated by a compressed air pilot valve.

The present invention includes a system having a water supply main or pipe coupled through a pressurized gas operated water valve to a sprinkler system. The sprinkler system is pressurized with a compressed gas, such as air. The compressed gas operates a pilot valve which controls the water valve. The water valve is a normally open unit in which the flow orifice is sealed by a disc, the disc being held in closed position by water pressure. The gas operated pilot valve maintains or releases the water pressure so causing the disc to open or close the water flow orifice. Preferably the compressed gas circuit includes a pressure gauge, a check valve to prevent backflow of water from the sprinkler system back to the pilot valve, and a pressure switch which senses reduction in pressure within the compressed gas which will sound an alarm to indicate low air pressure either through malfunction or through a sprinkler head having opened during a fire.

BRIEF DESCRIPTION OF THE DRAWINGS

The present invention will now be described with reference to the attached drawings in which.

DESCRIPTION OF THE PREFERRED EMBODIMENT

Figure 1:
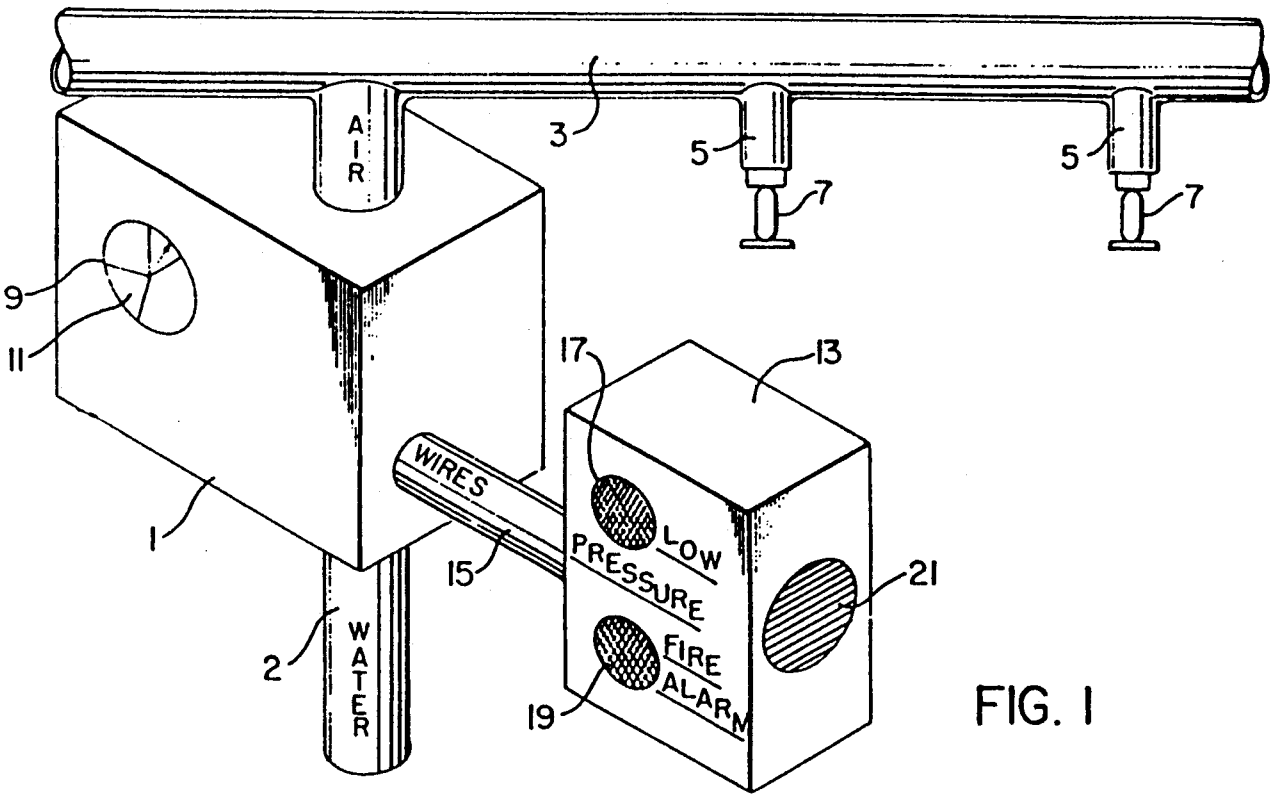
FIG. 1 shows a diagrammatic view of a system of the present invention.

Referring to the drawings and specifically FIG. 1, the system includes a valve and control system box 1 for receiving a pressurized water supply 2 and for connecting such supply to a sprinkler system 3 having sprinkler mounts 5 to which are secured standard heat operated sprinkler heads 7. The front of box 1 has an aperture 9 through which can be observed a pressure gauge 11 which shows the pressure of the compressed air in the pipe 3. A visual and audible alarm 13 is also secured to box 1 by a wiring conduit 15. The alarm 13 has a low pressure light 17, a fire alarm indicator light 19 and an audible alarm 21.

Figure 2:
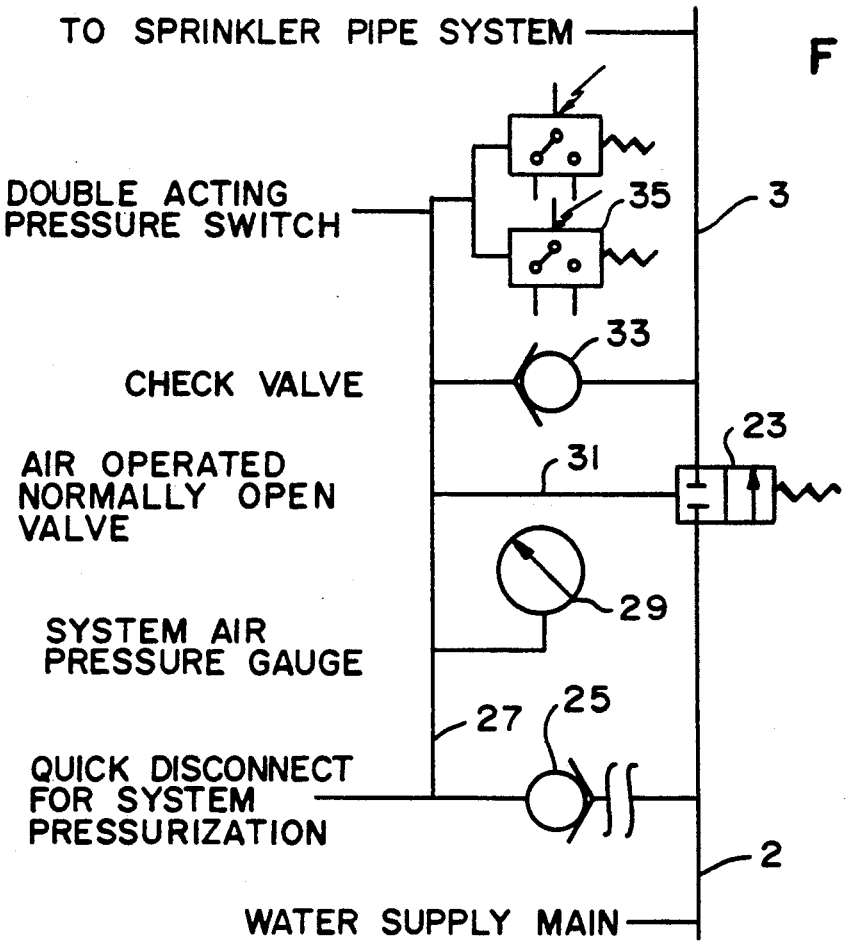
FIG. 2 is a circuit diagram of the system of those of FIG. 1.

Referring to FIG. 2 the water supply main 2 is coupled to an air operated normally opened water valve 23 which is one of a standard line valves manufactured by Ascolectric Limited of Brantford, Ontario, Canada. The model numbers of suitable valves are:

| | | |
|---|---|---|
| P 210 C35 | ¾" | N.P.T. |
| P 210 D14 | 1" | N.P.T. |
| P 210 D18 | 1¼" | N.P.T. |
| P 210 D32 | 1½" | N.P.T. |
| P 210 103 | 2" | N.P.T. |
| Bulletin 8210 | 2½" | N.P.T. |
| Bulletin 8210 | 3" | N.P.T. |

Figure 2A:
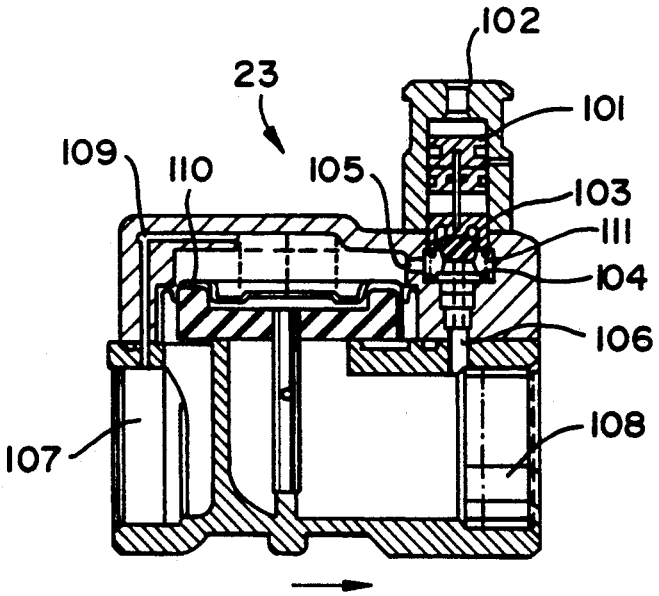
FIG. 2A is a schematic view of a typical suitable pilot operated valve.

One type of suitable valve is shown in FIG. 2A and is operated by a pilot piston 101 which has a compressed air inlet 102. The piston 101, when subjected to air pressure holds resilient valve 103 as a valve seat 104 to close passageway 105, 106 and so close the flow of water from inlet 107 to outlet 108 through passageway 109, 105, 106. In this condition the pressure of water at the inlet 107 holds down the piston 110 in its closed position so preventing water flow through the valve. When there is a loss of air pressure at inlet 102, valve 103 is lifted off seat 104 by spring 111, water flows into the outlet 108 through passageway 105, 106 and there is insufficient water flow through passageway 109 to maintain adequate pressure above piston 110. Piston 110 is therefore raised by the inlet water pressure and water freely flows through the valve and will continue to do so until the system feeding compressed air to inlet 102 is reestablished or a main water valve is closed. The sprinkler pipe system 3 extends from the downstream side 108 of valve 23 and feeds a sprinkler head system as shown in FIG. 1.

The compressed air part of the system has a quick disconnect 25 which feeds pipe 27, the pressure in the system being indicated by pressure gauge 29. A pipe 31 feeds compressed air directly to valve 23. A check valve 33 is positioned between pipe 27 and a pipe 3 to prevent backflow of water into the valve from the sprinkler system after activation. A double acting pressure switch 35 is coupled to pipe 27 and is electrically connected to the visual and audible alarms 17, 19 and 21. Standard electrical circuitry can be used for the alarm circuits.

The system operates as follows:

To charge the system, a supply of compressed air is fed into quick disconnect 25 through pipe 27 to raise the entire pressure up to approximately 40 pounds per square inch and close valve 23. The main water supply can then be opened to the valve 23 which will be held closed.

Figure 3:
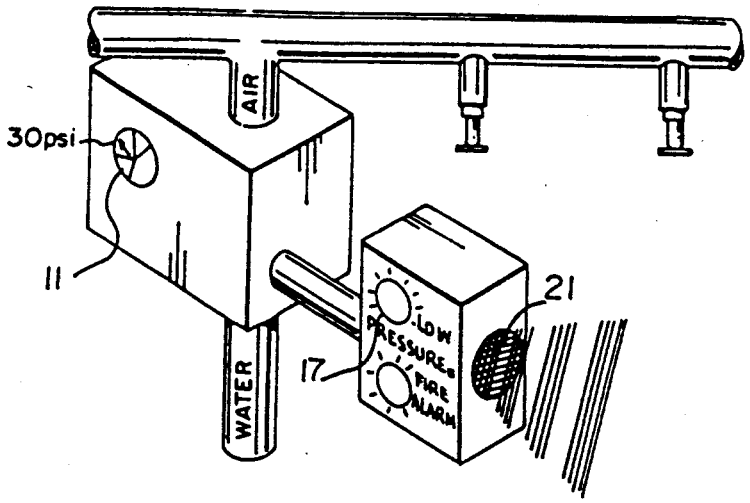
FIGS. 3, 4, 5 and 6 are diagrammatic views similar to FIG. 1 showing different states of the system.
Figure 4:
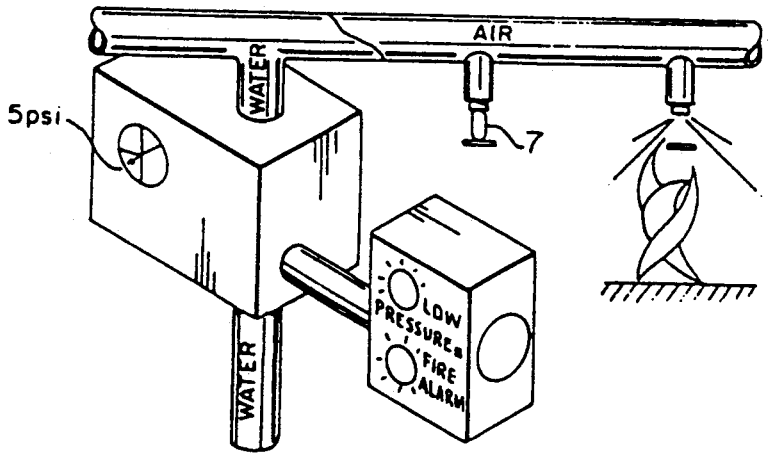

In the event of a gradual loss of system pressure through leakage, the pressure gauge will show the reduction in pressure and when it reaches 30 pounds per square inch as indicated in FIG. 3, the low pressure visual indicator will light up and the audible alarm 21 will produce an intermittent alarm signal. The source of leakage should then be located and the compressed air be brought up again to 40 pounds per square inch.

In the event of a fire, at least one of the standard sprinkler heads 7 will open, the air pressure in the system will drop as air leaves the sprinkler head, and the low pressure indicator and alarm will be activated, followed shortly by the fire alarm indicator and a continuous audible fire alarm signal. At the time the fire alarm visual and audible signals are produced, the valve 23 will operate through a reduction of air pressure in the air pilot valve and the water supply main will be connected directly to the sprinkler pipe system so flushing the sprinkler pipe system of air and providing water at the open sprinkler head or heads.

Figure 5:
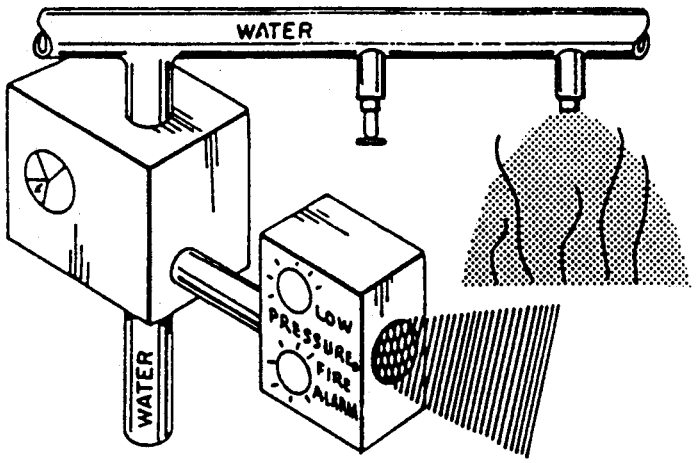
Figure 6:
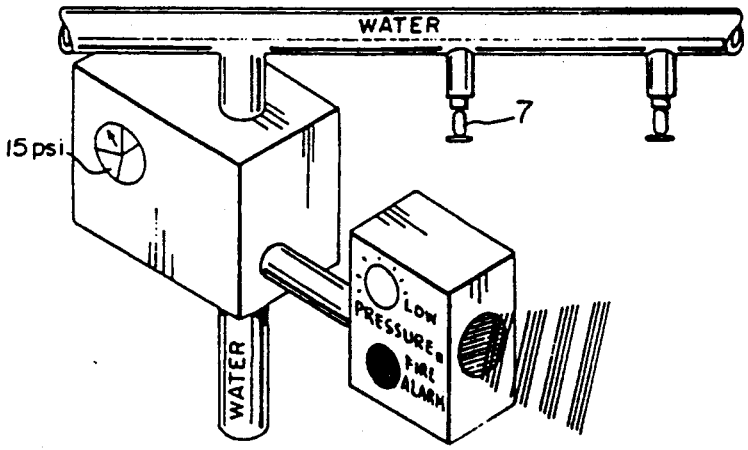

The sprinkler system is now fully functional to slow the spread of fire and it will continue to supply water through the sprinkler head until the water supply is terminated. This is the condition of the system as shown in FIG. 5.

In the event of a loss of system pressure due to a compressed air leak, the valve 23 would open under the influence of the pilot valve, the sprinkler pipe system would then be charged with water so that the system would function as a wet pipe system. The loss of air pressure would also activate the low pressure visual and audible alarms and possibly the fire visual and audible alarms, depending upon how low the system pressure reaches, however no water would be ejected from the system as the sprinkler heads 7 would still be closed. The sprinkler system would however then be prone to freezing, however the alarms should provide sufficient warning to the operator to check the system and put it back into a "safe from freezing" condition.

Figure 7:
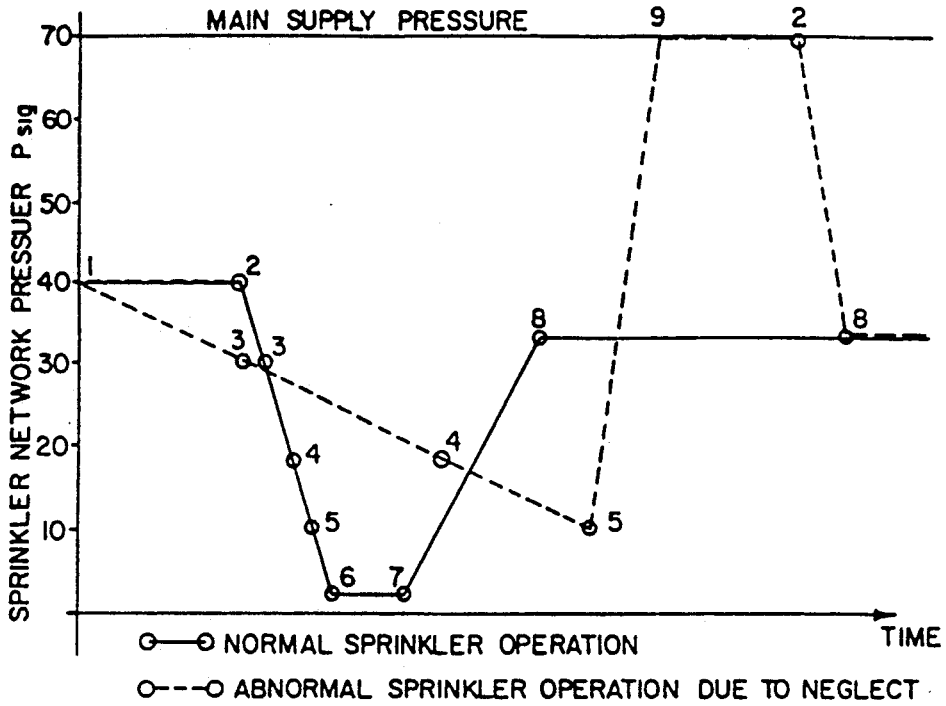
FIGS. 7 and 8 are graphs showing the operation of the system.

Referring to the graph as shown in FIG. 7, a more detailed analysis of the working of the system is provided as follows:

NORMAL SPRINKLER OPERATION

System charged to 40 p.s.i.g. and ready.

Sprinkler head opens due to fire and system loses pressure.

Low pressure warning is energized at 30 p.s.i.g. so providing visual and audible alarm.

Fire alarm visual and audible warnings are energized at 18.5 p.s.i.g.

Main water control valve opens at 10 p.s.i.g.

Water floods the sprinkler system against atmospheric pressure.

Water reaches the open sprinkler and builds up to full discharge pressure.

The system water pressure is stabilized at full sprinkler flow.

ABNORMAL SPRINKLER OPERATION DUE TO NEGLECT

System charged to 40 p.s.i.g. and ready.

Low pressure visual and audible warnings energized at 30 p.s.i.g.

Fire alarm visual and audible warnings energized at 18.5 p.s.i.g.

Main water control valve opens at 10 p.s.i.g.

As there is no sprinkler head open, the sprinkler system will be pressurized to full water main pressure which will then be held by the system.

Sprinkler head opens due to fire.

System pressure stabilized at full sprinkler flow.

It will again be noted that from point 3 in this abnormal sprinkler operation, all visual and audible warnings were ignored and no checks were made. Also, if there had been no fire during this abnormal sprinkler operation, the system would have been full of water and subject to freezing.

Figure 8:
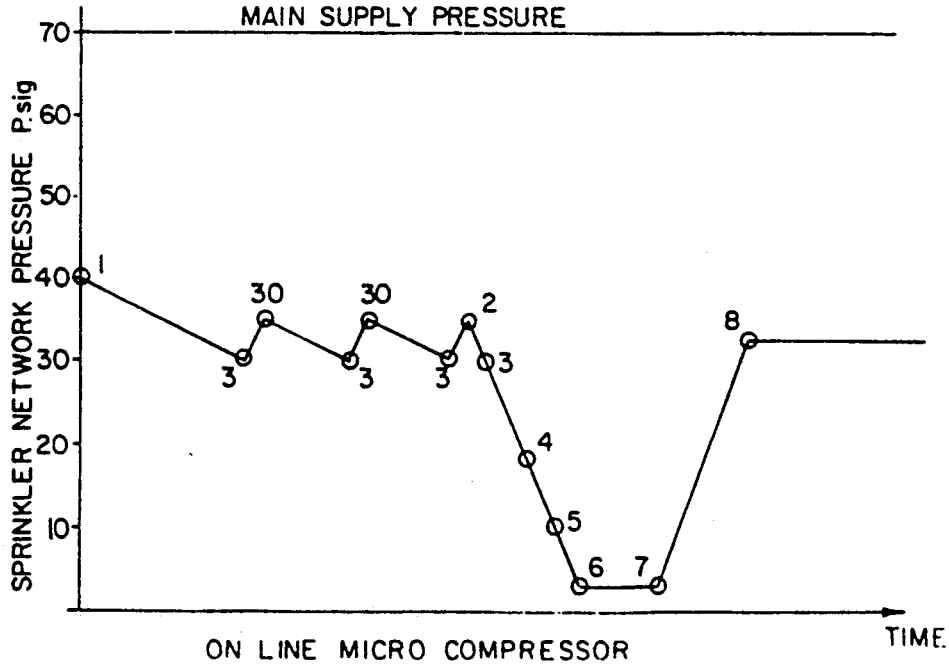

In another embodiment of the invention a micro-compressor is used in the system to automatically replenish loss of compressed air due to leakage, and FIG. 8 shows a graph in which a micro-compressor is utilized in the air system.

SYSTEM EQUIPPED WITH ON LINE MICRO-COMPRESSOR

System charged at 40 p.s.i.g. and ready.

Low pressure warning energized at 30 p.s.i.g. and turns on the micro-compressor.

The compressor increases the system pressure to 35 p.s.i.g. at which point a low system pressure switch opens and switches off both the low pressure warning and the micro-compressor.

Low pressure warning energized at 30 p.s.i.g. and turns on the micro-compressor.

The compressor increases the system pressure to 35 p.s.i.g. at which point the low system pressure switch opens and switches off both the low pressure warning and the micro-compressor.

Low pressure warning energized at 30 p.s.i.g. and turns on the micro-compressor.

The compressor increases the system pressure to 35 p.s.i.g. at which point the low system pressure switch opens and switches off both the low pressure warning and the micro-compressor. Coincidentally, a sprinkler head opens due to fire.

Low pressure warning energized at 30 p.s.i.g. and turns on the micro-compressor.

Fire alarm visual and audible warning energized at 18.5 p.s.i.g. and switches off the micro-compressor by separate relay so preventing the fire signal from being switched off by increasing control system pressure following pressurization of the water flooded system.

Main water control valve opens at 10 p.s.i.g.

Water floods the sprinkler system against atmospheric pressure.

The water reaches the open sprinkler head and builds up to full discharge pressure.

System pressure stabilized at full sprinkler flow.

It will be noted that when the micro-compressor is operated, the low pressure visual and audible warnings are also operated to alert that there is leakage which should be attended to. The use of a micro-compressor, however, does prevent the system from reverting from a wet system which could happen when the system was left unattended. The danger of freezing therefore can be avoided and system maintenance minimized.

Figure 10:
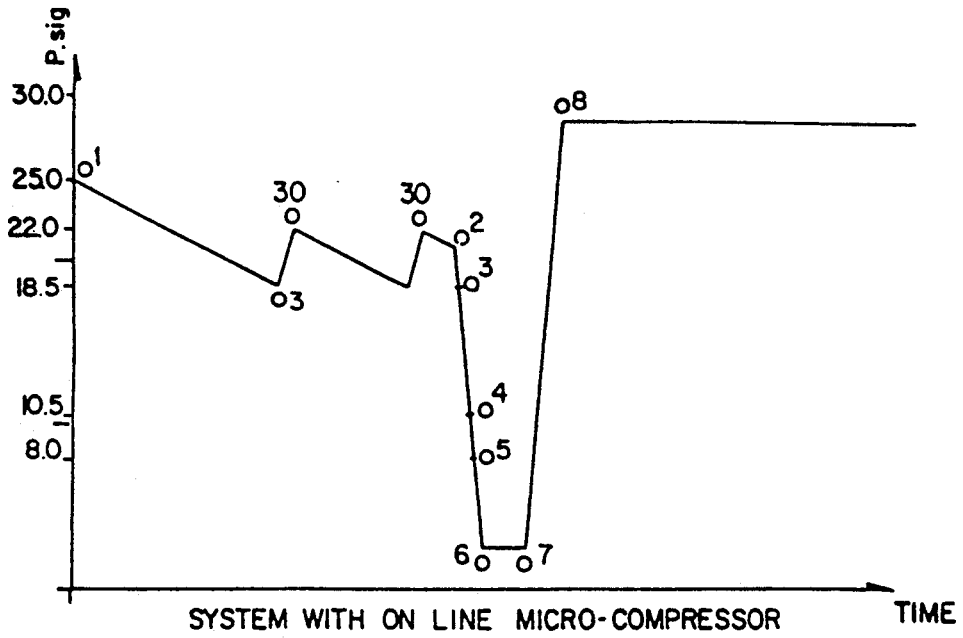
FIGS. 10 and 11 are graphs relating to a modified operation of the system.

The operation of the systems has been discussed with reference to FIGS. 7 and 8 utilizing various parameters, however these can obviously be altered to suit the conditions. In this regard, it has also been found that the use of a charging pressure lower than 40 pounds per square inch has been found to provide satisfactory and in fact superior operation. Referring specifically to FIG. 10 which shows the operation of the dry sprinkler system with an on-line micro-compressor, an analysis of the working of the system is as follows.

SYSTEM EQUIPPED WITH ON-LINE MICRO-COMPRESSOR

System charged at 25 p.s.i.g. and ready.

Low pressure warning energized at 18.5 p.s.i.g. and micro-compressor activated.

The compressor increases the system pressure to 22 p.s.i.g. at which point the low system pressure switch opens and switches off both the low pressure warning and the micro-compressor.

Low pressure warning energized at 18.5 p.s.i.g. and activates the micro-compressor.

The compressor increases the system pressure to 22 p.s.i.g. at which point the low system pressure switch opens and switches off both the low pressure warning and the micro-compressor.

Sprinkler head opens due to fire.

Low pressure warning energize at 18.5 p.s.i.g. and turns on the micro-compressor.

Fire alarm warning energized at 10.5 p.s.i.g. and switches off the micro-compressor by separate relay (this prevents the fire signal from being switched off by increasing control system pressure).

Main water control valve opens at 8 p.s.i.g.

Water floods sprinkler system against atmospheric pressure.

Water hits the open sprinkler and builds up to full discharge pressure.

System pressure stabilized at full sprinkler flow.

Figure 11:
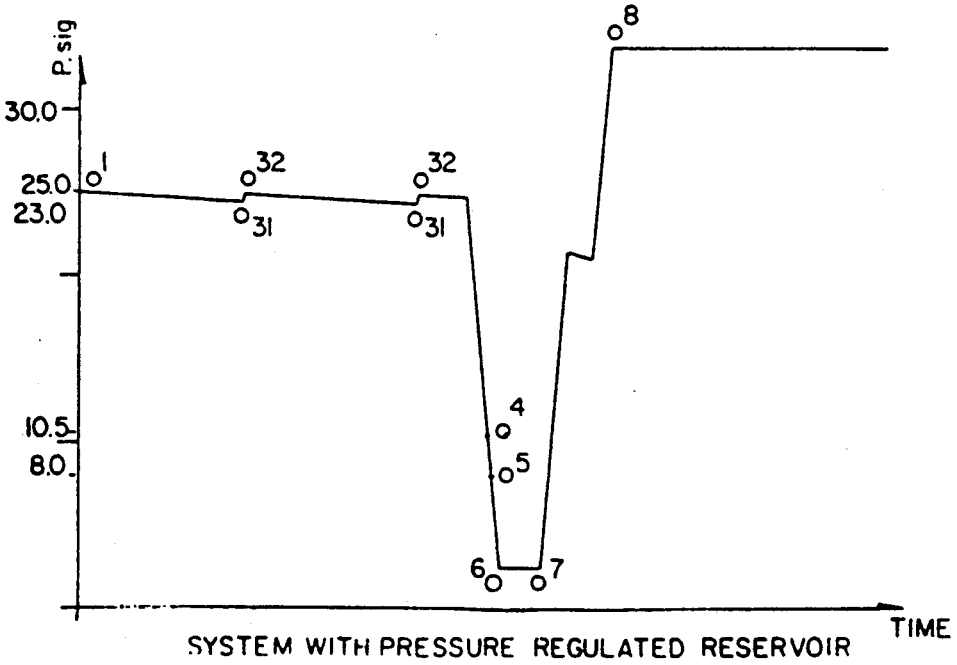

The air pressure can also be obtained from a pressure regulated reservoir which could already be used for other purposes in a commercial establishment such as, for instance, a service station. The operation of such a system is shown in FIG. 11 and can be analyzed as follows.

SYSTEM EQUIPPED WITH PRESSURE REGULATED RESERVOIR

System charged at 25 p.s.i.g. and ready.

Pressure loss triggers recharge valve from reservoir.

The recharged valve closes when differential pressure across the valve is lost.

Pressure loss triggers recharge valve from reservoir.

The recharged valve closes when differential pressure across the valve is lost.

Sprinkler head opens due to fire.

Fire alarm warning energized at 10.5 p.s.i.g. and shuts recharge valve (this prevents the fire signal from being switched off by increasing control system pressure).

Main water control valve opens at 8 p.s.i.g.

Water floods sprinkler system against atmospheric pressure.

Water hits the open sprinkler and builds up to full discharge pressure.

System pressure stabilized at full sprinkler flow.

Figure 9:
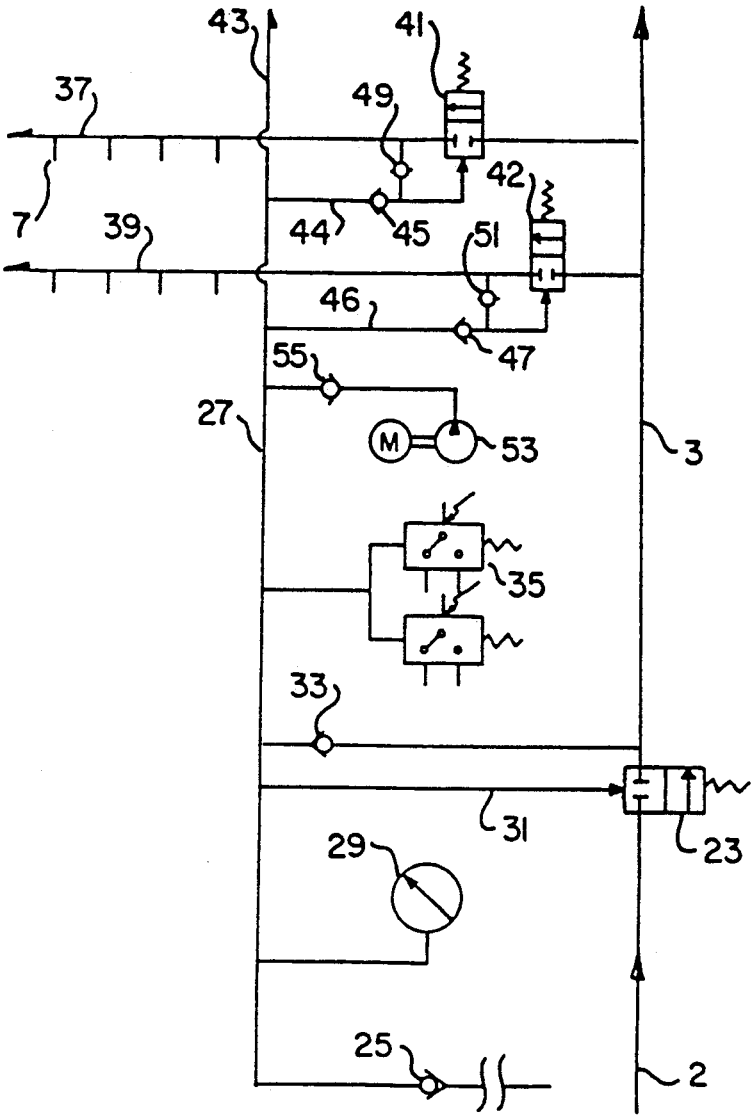
FIG. 9 is a circuit diagram of another embodiment of the dry sprinkler system of the present invention.

In FIG. 9 there is shown another embodiment of the system which, in addition to common features shown in the embodiment of FIG. 2 also include features which make the system react more quickly after a sprinkler head is opened under the influence of heat. The sprinkler pipe system has been modified in this embodiment so that there are separate sprinkler branches from the sprinkler main pipe 3, these pipes feeding individual zones and each is controlled by its own valve. Two separate zone pipes 37 and 39 are shown, these being controlled by air operated water valves 41 and 42 respectively, these valves being each identical to valve 23. Both of these valves 41 and 42 are operated through an extension 43 of the compressed air pipe 27. Pipes 44 and 46 feed compressed air respectively to valves 41 and 42 through respective check valves 45 and 47. Check valves 49 and 51 are positioned to quickly bleed air from the valve when the air pressure in one of the sprinkler zones drops due to a sprinkler head opening.

In order to replenish the air in the system, as well as the quick disconnect 25, a micro-compressor 53 is used, this compressor feeding air through check valve 55 into the compressed air pipe 27, upon activation of the circuit which controls the low pressure alarm. In the event that sprinkler head 7 as identified in FIG. 9 opens due to a fire in that zone, pilot air pressure to valve 41 will be lost in pipe 37 through check valve 49 such that the zone valve 41 will quickly open. The compressed air from pipe 27 will also quickly vent through pipe 44 and branch 37 thus venting the pilot pressure through pipe 31 from the main valve 23. Thus the main valve 23 will open even before air pressure in the sprinkler main pipe 3 has fallen significantly. Water will thus flow much earlier from water supply main 2 into sprinkler pipe system 3 than in the previous embodiment and will then immediately flow through open valve 41 into the sprinkler zone pipe 37 and out of sprinkler 7. Unless the fire spreads to further sprinkler arms, the sprinkler heads will remained sealed and pressurized and the water supply will only have to flood the main and triggered zone. Thus the water will achieve full discharge pressure much quicker then in a non-zoned system which will avoid having to purge water from the pipes in the other zones if these are not affected by fire.

Figure 13:
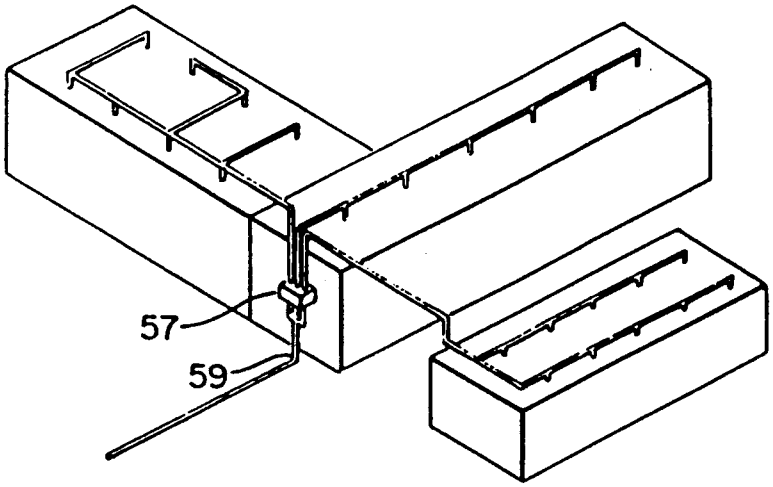
FIG. 13 is a diagrammatic view of the system including the control box of FIG. 12.
Figure 12:
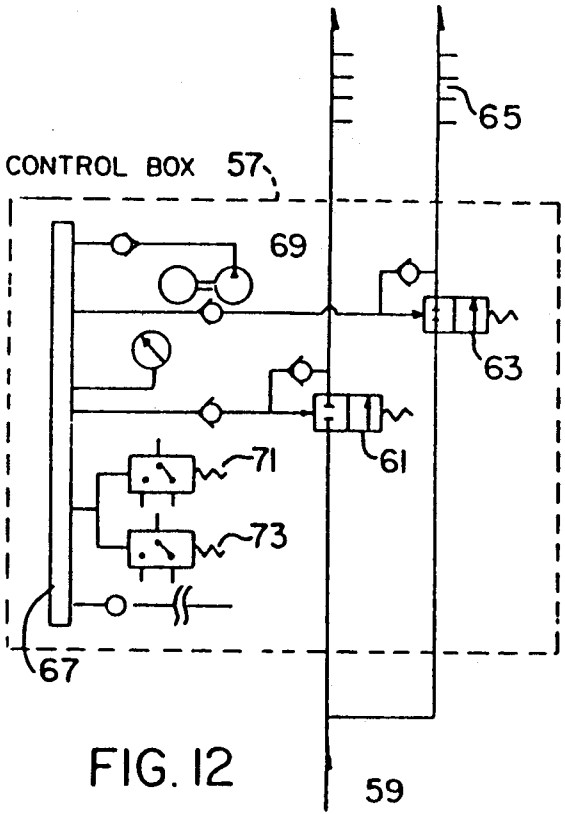
FIG. 12 is a circuit diagram of a further embodiment of the dry sprinkler system utilizing zone valves.

Referring now specifically to FIGS. 12 and 13 there is shown a parallel local zone valve system which has a control box 57 into which enters a main water pipe 59 which branches to pilot operated zone valves 61 and 63. Each zone valve is coupled to a separate sprinkler system 65, two being shown in FIG. 12 and three being shown in FIG. 13. Of course, in FIG. 13, three zone valves would be required in the control box 57. Each zone valve operates in the same manner as does the valve 23 as shown in FIG. 2. The air pressure to operate the zone valves 61 and 63 is supplied from an air pressure manifold 67 which can be either supplied by a central compressor and reservoir or as shown in FIG. 12 can be supplied by a micro-compressor 69. Alarms 71 and 73 are provided similarly to those shown in FIG. 2.

The control box which includes the zone valves can be located inside or outside of the protected area, however if located in an area in which it would be exposed to freezing conditions, then the control box and its main water supply pipe should be insulated and heat traced. The sprinkler distribution pipes can be totally external as they are normally dry.

The system will operate as follows:

The system is normally pressurized 25 p.s.i.g.

In the event of a system air leak, the pressure will fall to 18.5 p.s.i.g. when the system low pressure switch will close.

The low pressure warning signal is energized and the micro-compressor activated.

Pressure will rise until the switch opens again at 22 p.s.i.g. This process will continue on normal standby conditions.

In the event of a fire, a sprinkler head will open and discharge air from the system.

When the pressure has fallen to 10.5 p.s.i.g., the fire alarm circuit is closed and a warning is given. The micro-compressor which was activated as the pressure fell past 18.5 p.s.i.g. is also turned off.

At 8 p.s.i.g. the main water control valve for the discharged system opens allowing full flow to the open sprinkler.

Figure 14:
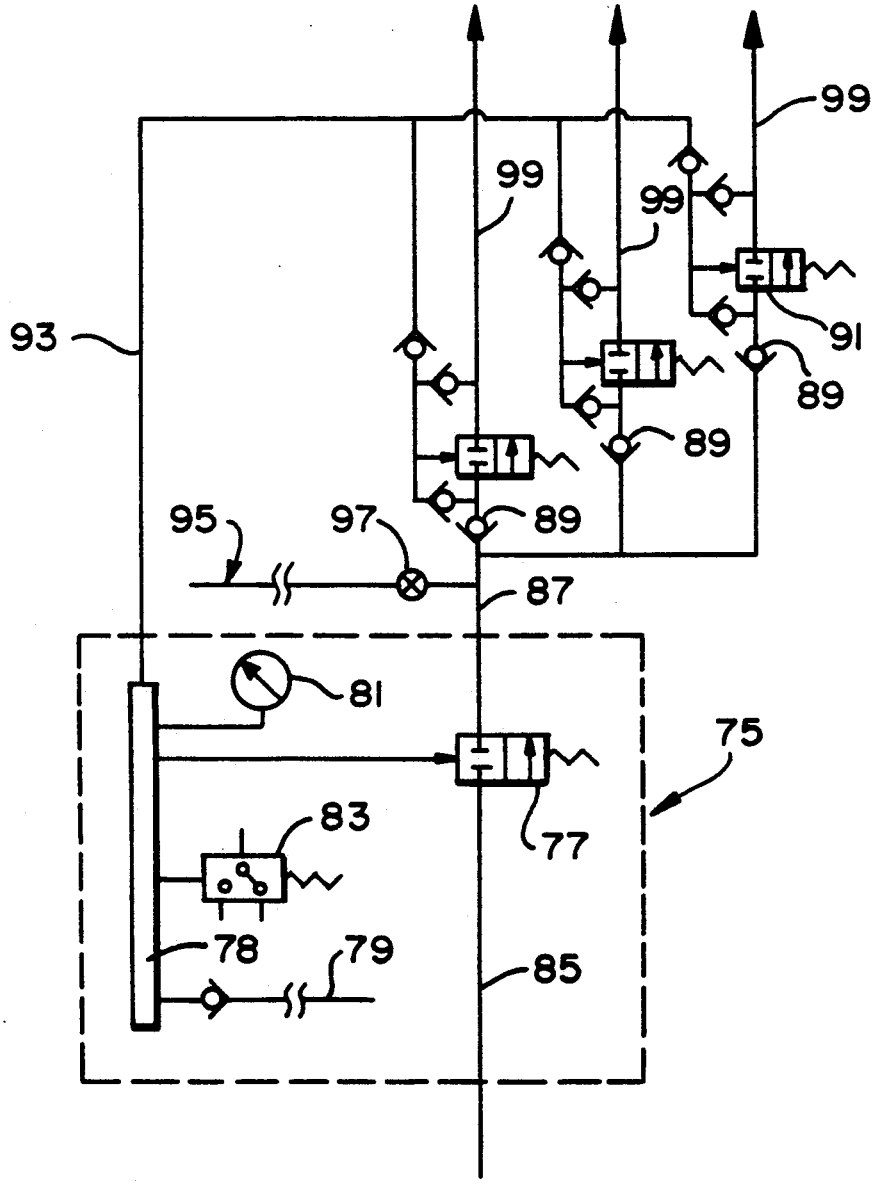
FIG. 14 is a circuit diagram of a further embodiment of the dry sprinkler system utilizing a dry distribution main.
Figure 15:
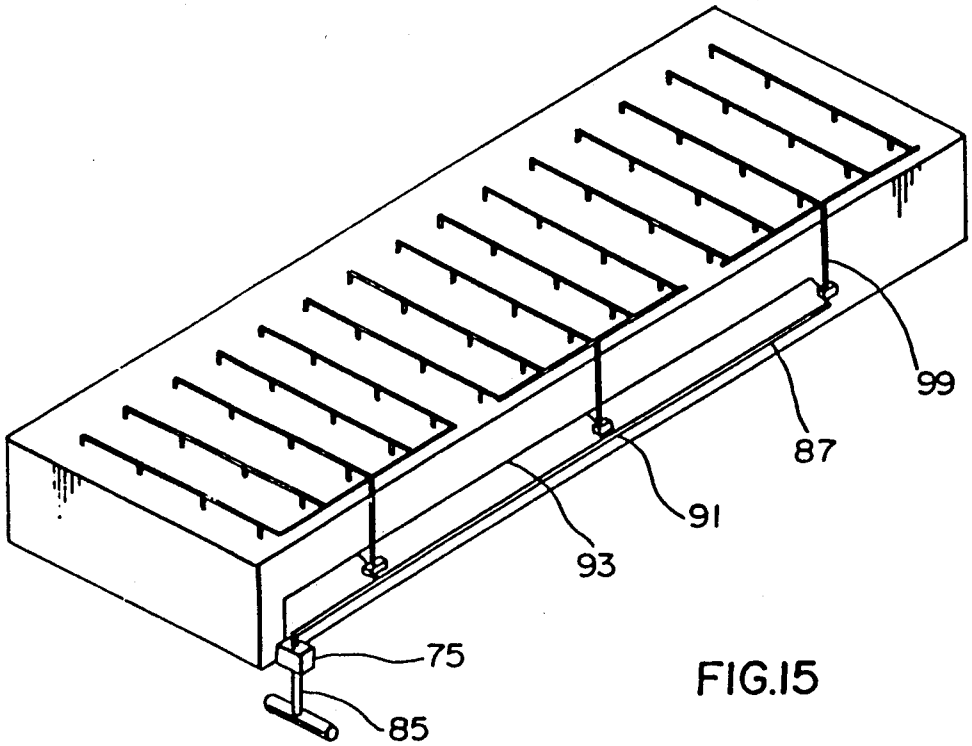
FIG. 15 is a diagrammatic view of a system utilizing the circuit of FIG. 14.

FIGS. 14 and 15 show a series remote zone valve system which will primarily be used for industrial applications such as large unheated outdoor storage or unheated indoor storage. A master control box 75 is used, this including a pilot valve 77 operated from an air pressure manifold 78 which has a normal compressed air supply 79, a pressure gauge 81 and an alarm unit 83. Water enters the control unit through a main water pipe 85. The outlet from pilot valve 77 is a dry distribution pipe 87 which is then coupled through one way valves 89 to zone pilot valves 91. The zone pilot valves are operated from the compressed air manifold 78 through a pipe system 93. An outlet 95 is coupled through a valve 97 to pipe 87. The sprinkler heads are fed from pipes 99 from the zone valves.

When originally charging the system, after the zone valves 91 are set, the pipe 87 can be discharged of compressed air through valve 97 and pipe 95 and the system will now be set.

The operation of the system is as follows:

In the event of a fire, a sprinkler head will open and discharge the air in its zone.

When the pressure has fallen to 10.5 p.s.i.g. the fire alarm circuit is closed and a warning is given.

A central enunciator board (not shown) could be used as an aid to location of the triggered zone in large buildings.

The air pressure in the control air pipe is lost due to the discharged zone, such that the air pilot on the main valve 77 allows it to open and flood the water main and the now open zone sprinkler valve and system.

All other zones remain sealed by their zone valves until their sprinkler heads are triggered to achieve progressive zone flooding.

Figure 17:
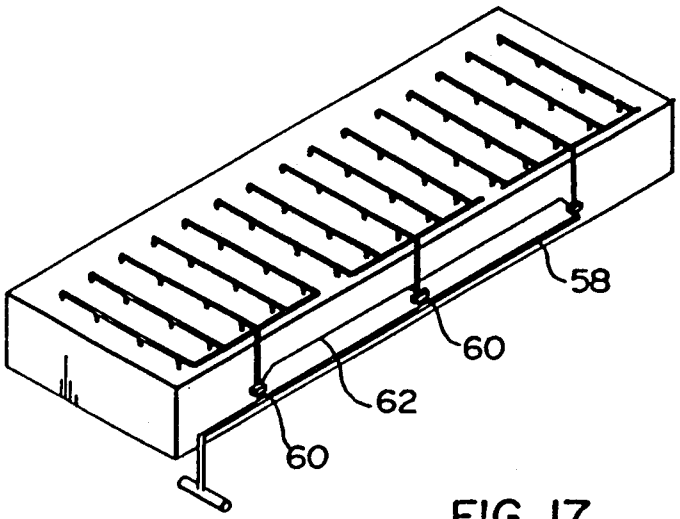
FIG. 17 is a diagrammatic view of the system utilizing the circuit of FIG. 16.
Figure 16:
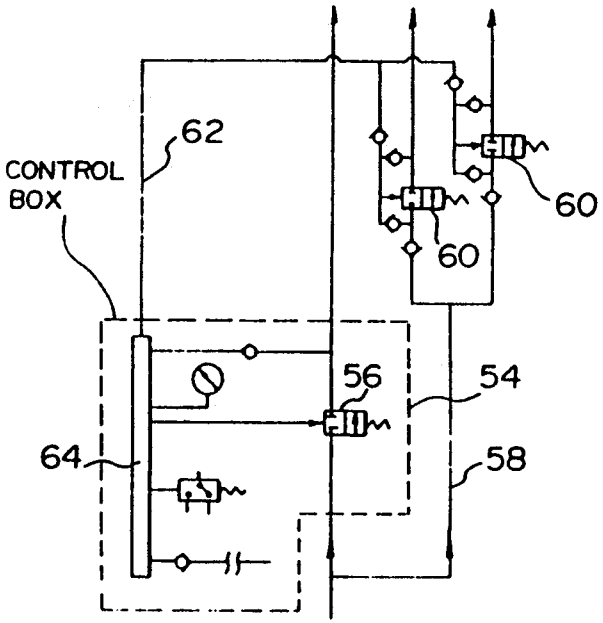
FIG. 16 is a circuit diagram of another embodiment of the dry sprinkler system having remote zone valves with a wet main.

FIGS. 16 and 17 show a parallel system having remote zone valve control having a control box 54 with a pilot controlled main valve 56 and the normal type of control system as shown in FIG. 14 as being included in the main control 75. A branch pipe 58 feeds to zone pilot valves 60 directly, these being operated by a pipe 62 from the main compressed air manifold 64.

The operation of the system is as follows:

In the event of a fire, a sprinkler head will open and discharge the air into its zone.

When the pressure has fallen to 10.5 p.s.i.g., the fire alarm circuit is closed and the warning is given.

A central enunciator board (not shown) would aid in the location of the triggered zone in large buildings.

The fire alarm circuit also electronically dumps compressed air from the control air pipes.

At 8 p.s.i.g., the zone water control valve opens allowing full flow to the open sprinkler. Note that all of the other zones remain dry as all of the other pilot valves remain closed.

Figure 19:
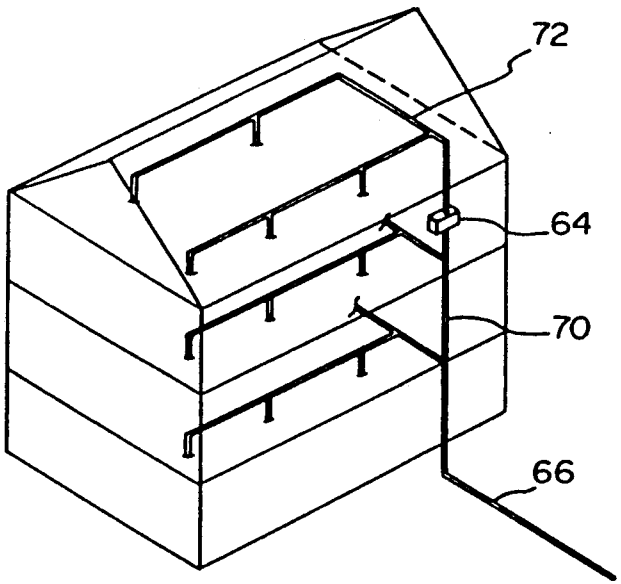
FIG. 19 is a diagrammatic view of the system utilizing the circuit of FIG. 18.
Figure 18:
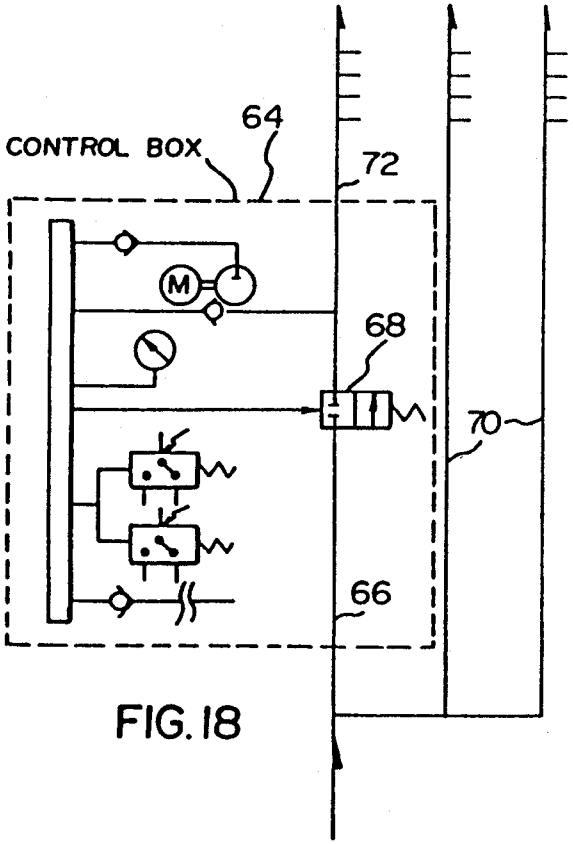
FIG. 18 is a circuit diagram of a further embodiment of the dry sprinkler system in combination with a wet sprinkler system.

The dual system shown in FIGS. 18 and 19 is one having wet and dry zones and is meant primarily for one or two family dwellings and other buildings in which there are heated and unheated areas.

The control box 64 is the normal self contained unit similar to the one shown in FIG. 2 and has a main water pipe 66 feeding into it. The water pipe is branched before the pilot valve 68 and has branches 70 which directly feed wet sprinkler systems. A dry pipe system 72 leaves the control box 64 and feeds a dry sprinkler system. The control box 64 will be normally located inside a heated area of the building and can have either a remote or local audible and visual fire alarm.

The system operates as follows:

The system is normally pressurized to 25 p.s.i.g.

In the event of a system air leak the pressure will fall to 18.5 p.s.i.g. when the system low pressure switch will close.

The low pressure warning signal is energized and the micro-compressor activated.

Pressure will rise until the switch again opens at 22 p.s.i.g. This process will continue under normal standby conditions.

In the event of a fire which opens a sprinkler head in systems 70, water will be rejected through the open sprinkler head. In the event of a fire which opens a sprinkler head in a dry system 72, air will be discharged from the system.

When the pressure has fallen to 10.5 p.s.i.g., the fire alarm circuit is closed and a warning is given. The micro-compressor which was activated as the pressure fell past 18.5 p.s.i.g. is also turned off.

At 8 p.s.i.g. the main water control valve opens allowing full flow to the open sprinkler through pipe 72.

It is also possible to easily test the dry systems disclosed without flooding the dry system by inserting extra valves at required places and utilizing an extra pressure gauge to monitor the pressure at the inlet side of the valve. The sprinkler system can then be tested with air pressure above by closing off the water supply and using air pressure on both sides of the valve. The testing procedures will not be described in detail as there are various procedures which can be followed to comply with local firecodes, these being obvious to a person skilled in this field. It is thus seen that a dry sprinkler system has been disclosed which is emenantly suitable for use in residences, restaurants, service stations and the like which do not require large commercial installations, as this disclosed system can be used with piping from ¾ of an inch diameter up to 3 inch diameter, this larger diameter being the minimum diameter at which commercial systems operate. Various combinations of the above described systems can of course be made within this invention and, although it has been indicated that the main use of this system is for relatively small sprinkler systems, it can of course be used in larger sizes with existing full size systems which utilize 6 inch diameter or larger pipes as the use of compressed air pilot operated valves in such systems is much more reliable than existing clapper valve systems.

The invention will therefore only be limited by the scope of the following claims.

The embodiments of the invention in which an exclusive property or privilege is claimed are defined as follows:

1. A dry sprinkler system comprising:

a main dry sprinkler pipe;

means for charging said main dry sprinkler pipe with compressed gas;

water supply means for supplying water to said sprinkler pipe upon actuation of the sprinkler system;

a valve having an inlet in communication with said water supply and an outlet in communication with said main dry sprinkler pipe;

said valve including a disc for opening and sealingly closing said valve and an actuating means for controlling said opening and closing of said valve, said disc being oriented to close by moving toward said outlet and thereby resisting leakage due to any substantial changes in the water supply pressure;

said valve being closed, maintained in a closed condition and opened exclusively by the water pressure applied to said disc, said opening and closing of said valve being controlled by said actuating means which is responsive solely to changes of said compressed gas pressure in said main dry sprinkler.

2. A sprinkler system according to claim 1, wherein said actuating means comprises a gas-operated pilot, said pilot including a piston, said piston being movable in response to gas pressure changes within said pipe and on the application of a predetermined minimum gas pressure within said pipe, to responsively close a drain orifice to stop the flow of water from the upstream side of said disc and thereby increase the water pressure applied to said disc to close said valve, and on a drop of the gas pressure within said pipe below said predetermined pressure responsively open said drain orifice to release said water pressure on the upstream side of said disc and open said valve.

* * * * *